US005976340A

United States Patent [19]

Sheldon et al.

[11] Patent Number: 5,976,340

[45] Date of Patent: Nov. 2, 1999

[54] METHOD OF FABRICATING ELEVATED TEMPERATURE APPLICATION PARTS WITH A SERRATED SURFACE

[75] Inventors: Robert G. Sheldon, Woodstock; Eric G. Smith, Marietta, both of Ga.

[73] Assignee: Lockheed Martin Corporation, Bethesda, Md.

[21] Appl. No.: 08/959,134

[22] Filed: Oct. 28, 1997

[51] Int. Cl.[6] ..... C25D 1/10

[52] U.S. Cl. ..... 205/70; 205/67

[58] Field of Search ..... 205/67, 70

[56] References Cited

U.S. PATENT DOCUMENTS

| | | | |
|---|---|---|---|
| 5,183,551 | 2/1993 | Werthmann | 205/70 |
| 5,230,259 | 7/1993 | Sheldon | 76/101.1 |
| 5,453,173 | 9/1995 | Oyama | 205/70 |

OTHER PUBLICATIONS

W.H. Prine "Electrofoming Difficult Shapes", Product Engineering, vol. 19, No. 12, pp. 86–89, Dec. 1948.

H.D. Rice A New Look at Electroformed Parts, Material & Methods, Reinhold Publishing Corp., Sep. 1955.

W.H. Safranek "Don't Overlook Electroforming", Product Engineering, pp. 609–613, Jun. 1961.

Marv Rubenstein "Some Tips on Electroforming" Metal Finishing, pp. 52–56, Feb. 1965.

*Primary Examiner*—Kathryn Gorgos
*Assistant Examiner*—Erica Smith-Hicks
*Attorney, Agent, or Firm*—Eric R. Katz

[57] ABSTRACT

A method is disclosed for fabricating a low cost, elevated-temperature resistant part with a serrated surface and elevated-temperature structural properties similar to (within fifty percent (50%)) a superalloy material comprising the steps of: forming a master tool having the desired serrated surface; electro-forming the elevated-temperature resistant part by depositing three alloying elements comprising nickel, cobalt and manganese onto the master tool in the amounts of about 60%–70% nickel, 40%–30% cobalt and 0.05%–0.10% manganese; and separating the elevated-temperature resistant part from master tool.

7 Claims, 7 Drawing Sheets

METHOD OF FABRICATING ELEVATED TEMPERATURE APPLICATION PARTS WITH A SERRATED SURFACE

BACKGROUND OF THE INVENTION

1. Field of the Invention

The present invention generally relates to a method of fabricating elevated-temperature resistant parts having a serrated surface, and more particularly, to an electro-forming method of fabricating hardware with a serrated surface and elevated-temperature structural properties which are at least fifty percent (50%) of those of superalloy materials.

2. Background Discussion

There are numerous applications for the use of elevated-temperature resistant parts having a serrated surface. One prior art approach to making such parts is taught by the Method Of Making A Surface With A Sharp Edge disclosed by U.S. Pat. No. 5,230,259 to Sheldon, a named inventor of the present invention, said patent being assigned to the assignee in interest of the present invention.

The method disclosed by the Sheldon '259, known as diffusion bonded ribbon inconel, is used to manufacture parts for elevated-temperature applications requiring serrated surfaces and high mechanical properties approaching those of superalloys.

However, the Sheldon method is highly labor intensive and thus, costly. In addition, it is very difficult to achieve adequate sharp edges on the serrations. Moreover, to date, the Sheldon method can only be used to fabricate rectangular panels that must then be formed and welded to construct a desired part having a non-rectangular configuration.

Another known method for creating parts with a serrated surface is diamond machining of the inconel material. This method is very labor intensive and makes it difficult to achieve the required serrated surface.

SUMMARY OF THE INVENTION

Accordingly, it is an object of the present invention to provide a method of fabricating elevated-temperature resistant parts with a serrated surface which overcomes the deficiencies of the prior art.

It is yet an object of the present invention to provide a method of fabricating elevated-temperature resistant parts with a serrated surface for applications where superalloy elevated temperature strengths are not required and structural properties at elevated temperature which are approximately fifty per cent (50%) of those of superalloy materials are acceptable.

It is a further object of the present invention to provide a method of fabricating elevated-temperature resistant parts which reduces the time and cost of fabrication of such parts when compared to known methods.

Advantageous features of the present invention include: 1) through the use of electro-forming of an elevated-temperature capable material, the requirement for a serrated surface is met or surpassed, 2) cost and time to process is reduced since the electro-forming process can be used to generate a part with the required serrations in a single step with no forming or surface machining required and 3) the need for welds and surface feature breaks are eliminated as compared to previously known techniques in which only rectangular panels can be fabricated.

These and other objects, advantages and features of the present invention are achieved, according to one embodiment of the present invention, by a method of fabricating an elevated-temperature resistant part with a serrated surface and elevated-temperature structural properties within about fifty per cent (50%) of those of a superalloy material comprising the steps of: forming a master tool having a serrated surface; electro-forming the elevated-temperature resistant part by depositing three alloying elements comprising nickel, cobalt and manganese onto the master tool in the amounts of about 60%–70% nickel, 40%–30% cobalt and 0.05%–0.10% manganese; and separating the elevated-temperature resistant part from the master tool.

DETAILED DESCRIPTION OF THE PREFERRED EMBODIMENT(S)

Figure 1:
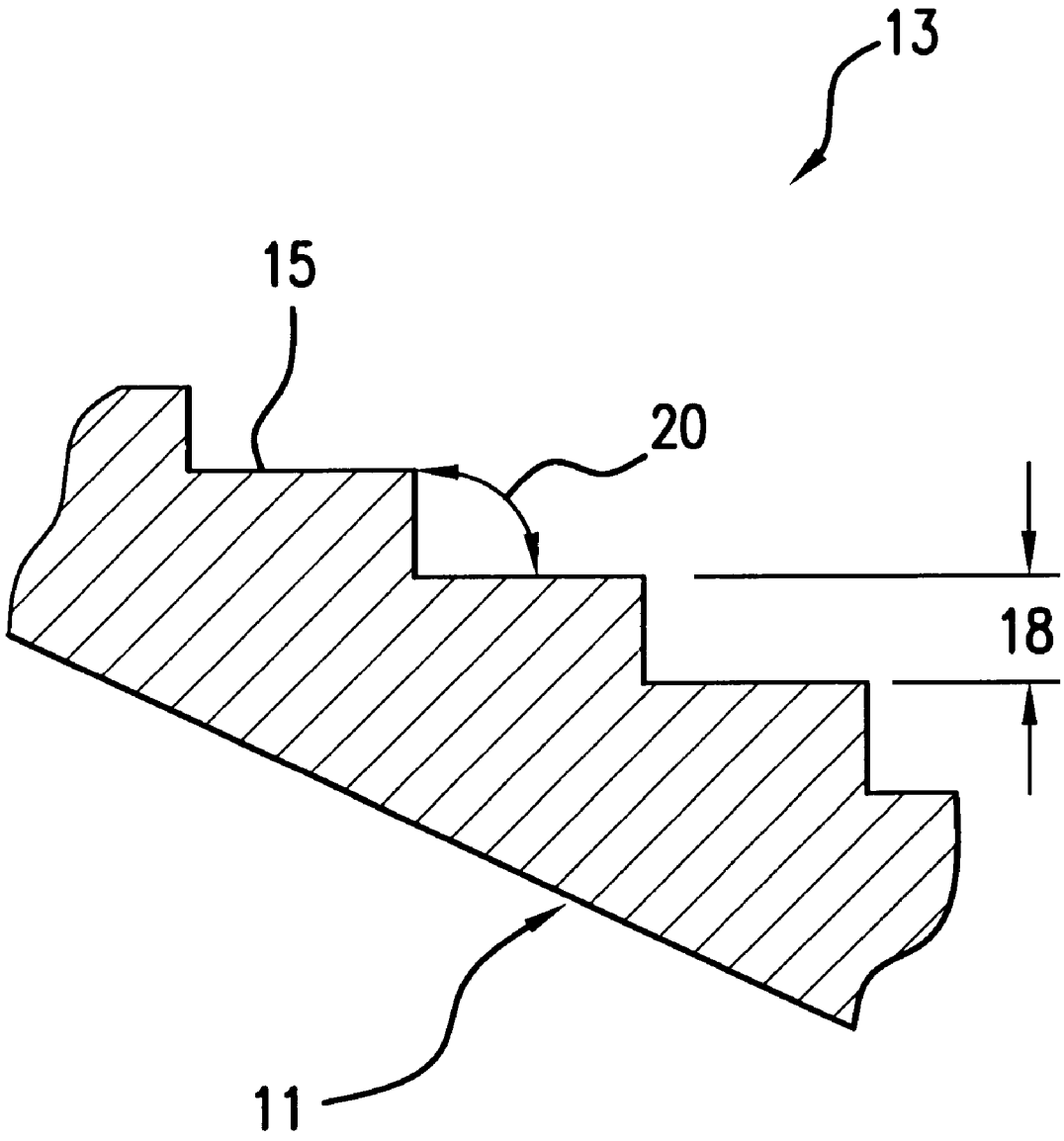
FIG. 1 illustrates the structural requirements and surface features of an elevated-temperature part envision to be manufactured in accordance with the method of the present invention.

Referring to FIG. 1, the requirements are illustrated for an elevated-temperature resistant part, generally indicated at 11, to be made in accordance with one embodiment of the method of the present invention. The elevated-temperature part 11 is required to have structural properties, at elevated-temperature approaching those (about 50%) of superalloy materials, such as, for example, Inco 718 or Inco 625 and a serrated surface, as generally shown at 13.

As shown in FIG. 1, the serrated surface 13 comprises, for example, a very flat and smooth surface 15 having: 1) a highly smooth surface, and 2) a step height 18 of about 0.010 inch to 0.100 inch at an included angle 20 of about 90 degrees, i.e., substantially square corners. To reduce stress concentration, it is also possible to corner radius the square inside corner in accordance with the present invention.

Figure 2A:
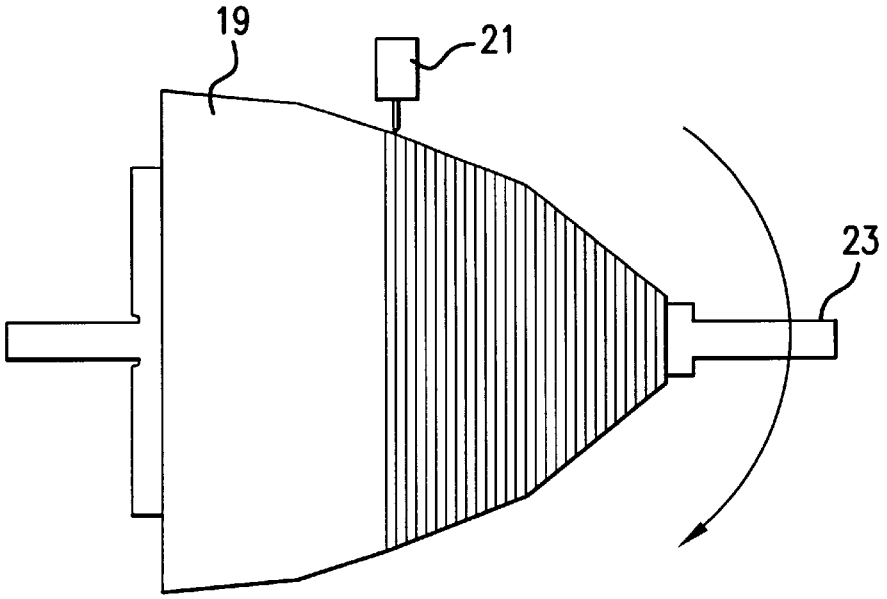
FIGS. 2A-2B illustrate the fabrication of various configurations of an aluminum male mandrel for use in accordance with one embodiment of the present invention.
Figure 2B:
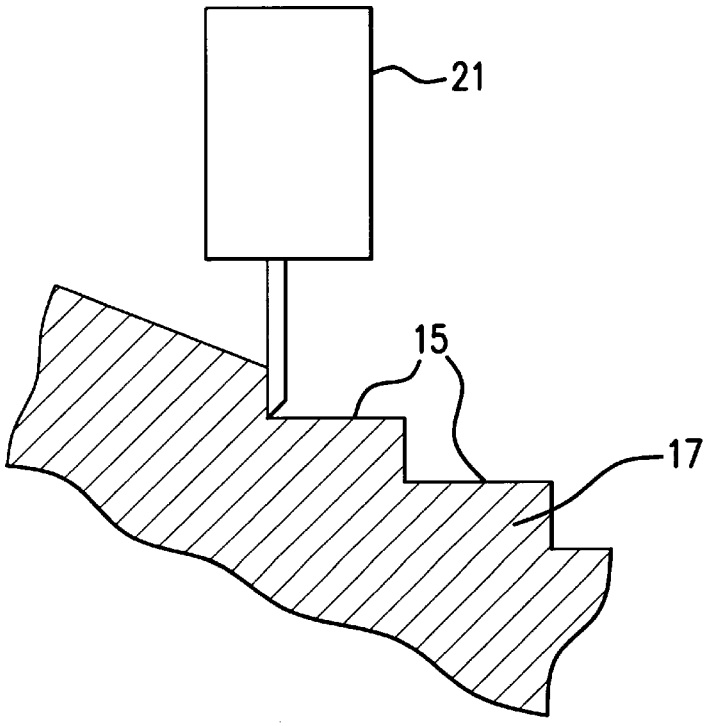

The serrated surface 13 of part 11 is generated through electro-forming nickel alloying elements onto a master tool 17 having the required grooved surface 15 and a highly smooth surface. Referring to FIGS. 2A-2B, the master tool 17 is created by first diamond machining a mandrel 19 comprising an easily machined material, such as, for example, an aluminum or copper alloy. Serrations 15 are machined into the mandrel 19 using a diamond cutter 21 which removes precise quantities of material as the mandrel 19 is rotated on a lathe 23 as best seen in FIG. 2A.

The resulting master tool 17 forms an aluminum or copper alloy master which is then used in the electro-forming process in accordance with the present invention as either a primary electro-forming tool from which the final elevated-temperature part 11 is generated or a secondary electro-forming tool which is used as a reverse master as will be more fully understood hereinafter.

Figure 3:
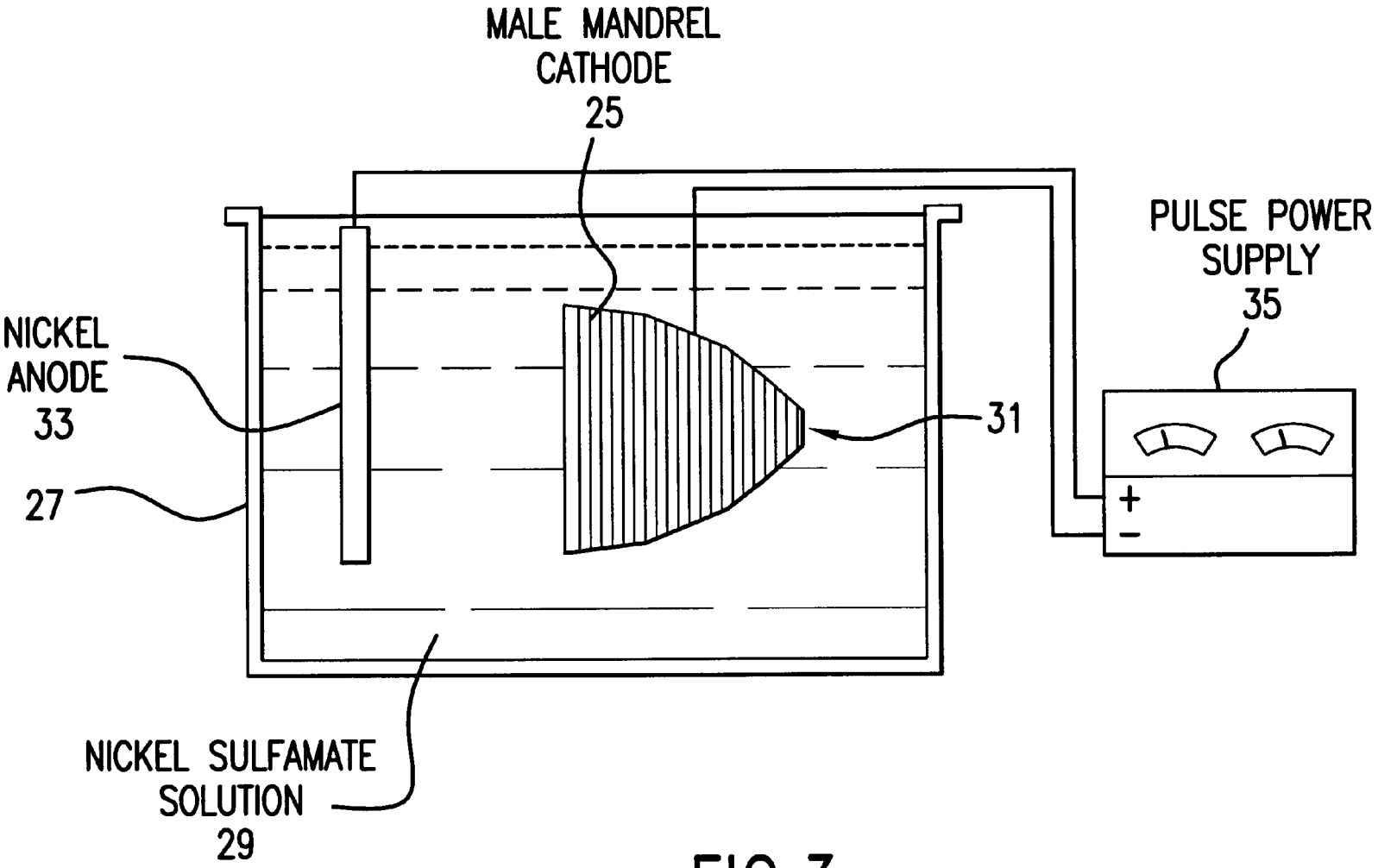
FIG. 3 illustrates the step of electro-forming nickel onto a male mandrel in accordance with one embodiment of the present invention.

Referring to FIG. 3, when the master tool 17 is used as a secondary electro-forming tool, pure nickel is electro-formed onto the master tool 17 to generate a reverse tool 25. In this regard, the master tool 17 is immersed in a bath 27 of nickel sulfamate solution 29 of, for example to form a cathode, generally indicated at 31. A nickel anode 33 is also immersed in the nickel sulfamate solution with the master tool anode 31, which are both connected to a pulse power supply 35 as is well known in the art. Since a reverse tool 17 requires a relatively thick nickel deposit for tool strength and rigidity, about 0.25 inch of nickel, for example, is deposited on the master tool 17.

Separation of the master tool 17 from the reverse tool 25 is accomplished by cooling the assembly, for example, with dry ice, and utilizing the thermal expansion difference between aluminum and nickel to facilitate the separation of the reverse tool 25 from the master tool 17 since aluminum has a very large thermal expansion coefficient relative to nickel and therefore shrinks away from the reverse tool 25 when cooled.

Once the reverse tool 25 is separated from the master tool 25, the reverse tool 25 is machined into sections, for example, thirds for axisymmetric geometries, then attached back together using clamps and seam sealant. Fabricating a reverse tool into sections allows final part separation by disassembly of the reverse tool.

For sacrificial tools, a thin nickel layer of, for example, about 0.010 inch is deposited on the reverse tool and then reinforced with glass epoxy. Sacrificial tools may also be fabricated via molding a polymer onto the surface of the master tool. In both cases, separation of the reverse tool from the final part can destroy the reverse tool.

Figure 4:
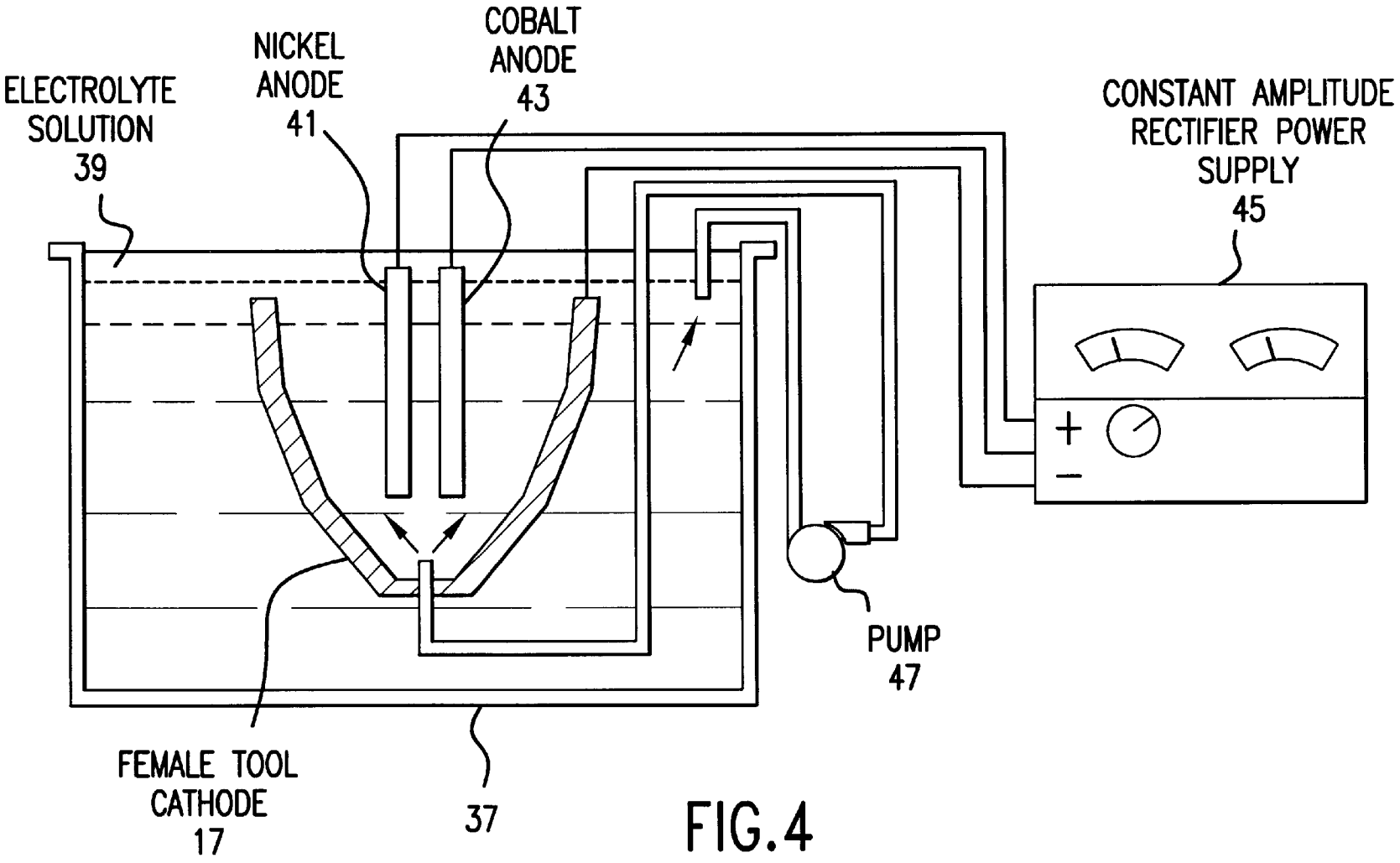
FIG. 4 illustrates the step of electro-forming Ni—Co—Mn onto a female mandrel in accordance with a further embodiment of the present invention.
Figure 5B:
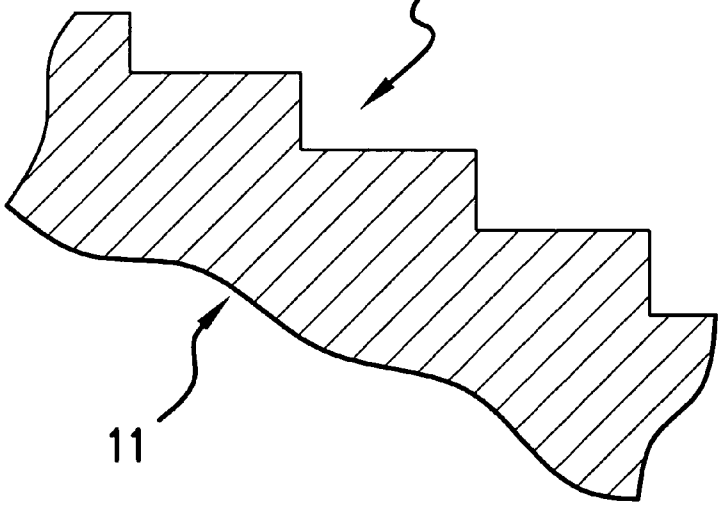
FIG. 5A illustrates the resulting Ni—Co—Mn electro-formed part having serrations identical to the diamond turned aluminum mandrel of FIG. 2 and structural properties approaching (within 50%) Inco 718 and FIG. 5B is a detailed illustration of the circled portion of FIG. 5A.
Figure 5A:
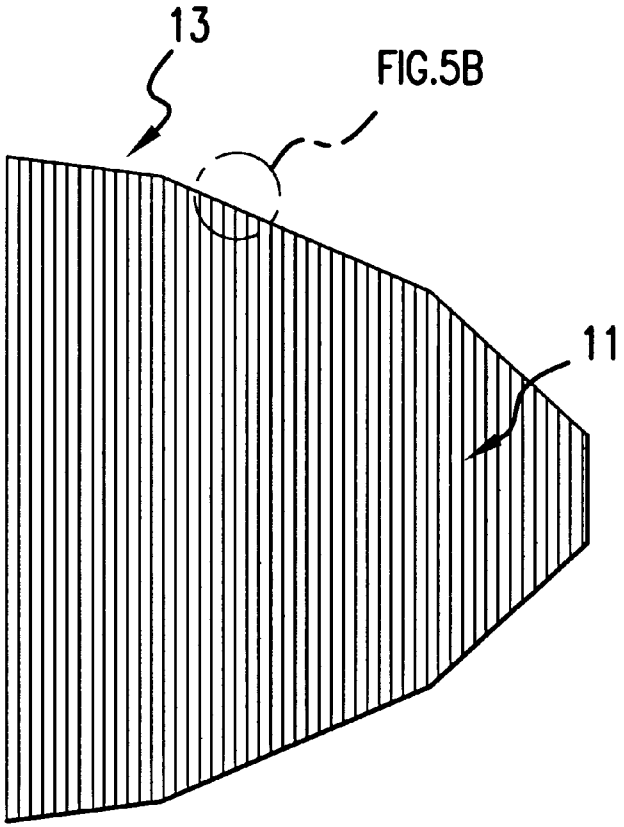
Figure 6:
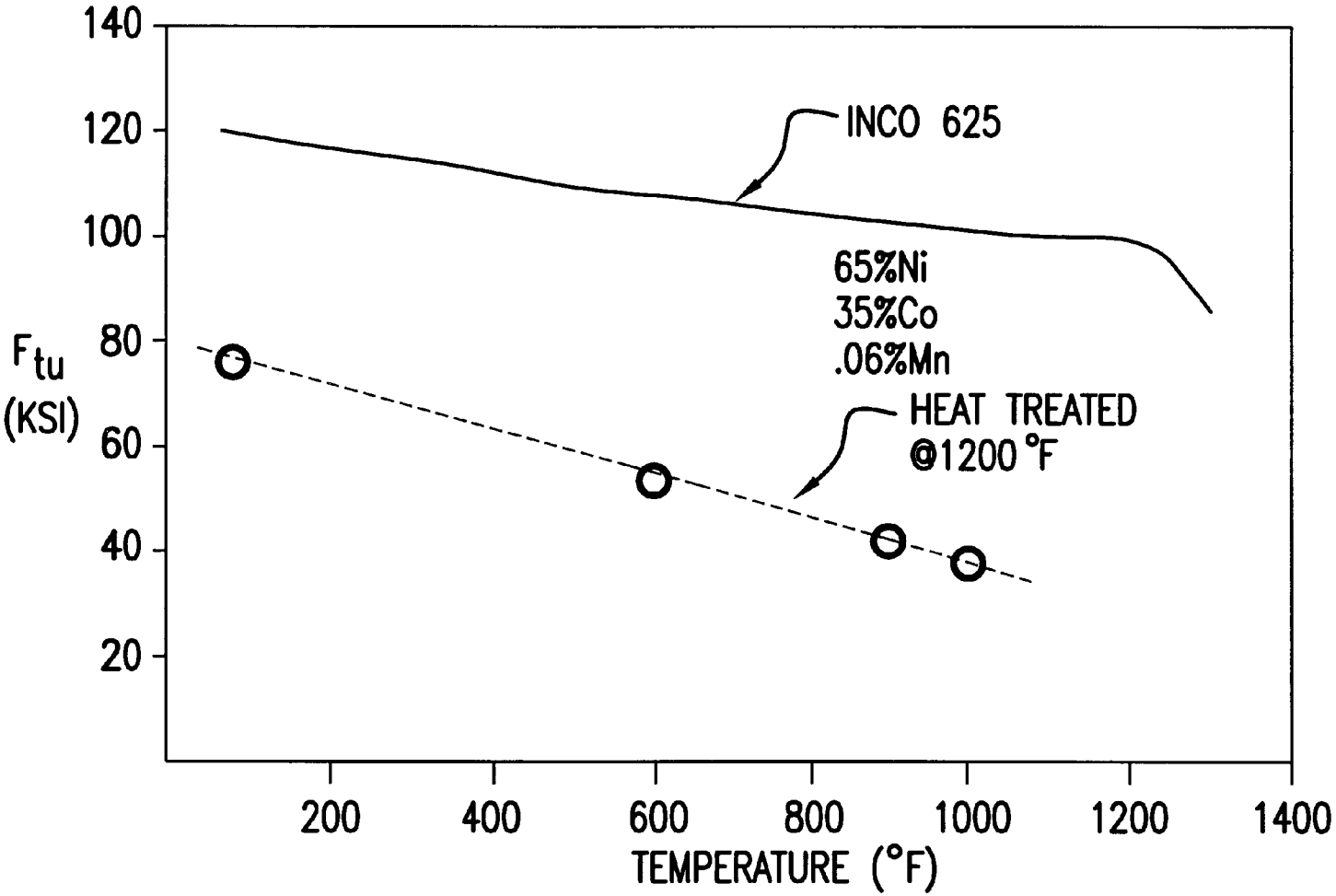
FIG. 6 is a graph illustrating the effect of temperature on ultimate tensile strength of an NiCoMn electro-formed part made in accordance with the present invention as compared with an existing superalloy material Inco 625.
Figure 7:
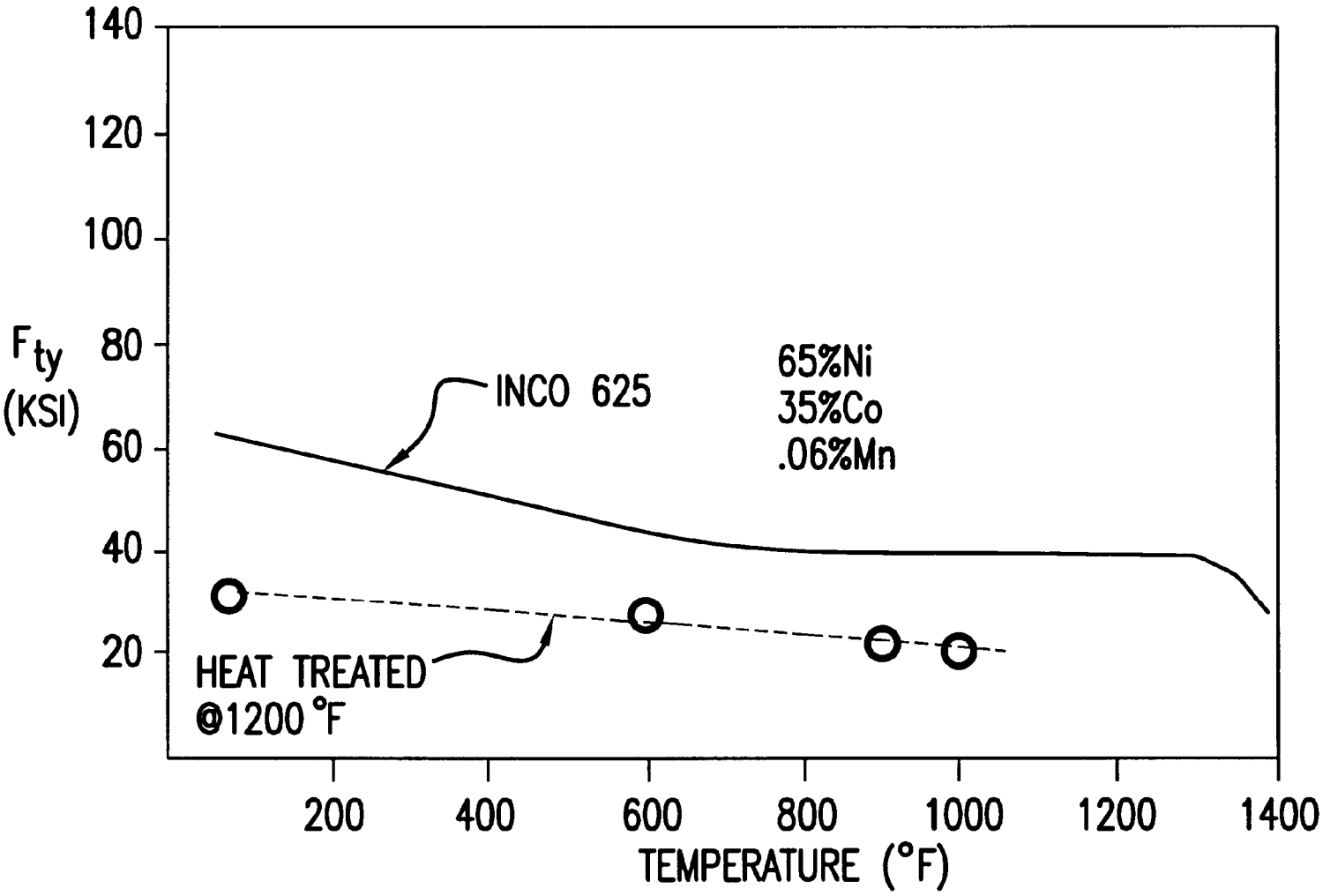
FIG. 7 is a graph illustrating the effect of temperature on yield strength of an Ni—Co—Mn electro-formed part made in accordance with the present invention as compared with an existing superalloy material Inco 625.

Referring to FIG. 4, electro-forming of the elevated-temperature resistant part 11 is accomplished by electro-depositing three alloying elements, nickel, cobalt and manganese, onto either the master tool 17 or the reverse tool 25. This electro-forming process is performed in a bath 37 of electrolyte solution 39 containing manganese. Nickel and cobalt anodes 41, 43, electrically connected to a constant amplitude rectifier power source 45, are immersed in the manganese electrolyte solution 39 along with the tool 17, which is also connected to the power source 45 to form a cathode.

A pump 47 is used to increase the flow of solution 39 over the surface of the tool 17 to provide faster deposition rates, uniformity of part thickness and uniformity of part chemistry. Based on structural testing of the alloy, the required chemistry of the final part is: about 60%–70% nickel, 40%–30% cobalt and 0.05%–0.10% manganese.

In this regard, deposition of Ni—CO—Mn alloys is more complicated than deposition of NiCo or NiMn alloys. Cobalt deposits preferentially over nickel, so the plating parameters must be carefully controlled in order to maintain the desired metal ratios in both the electrolyte and the deposited alloy. High peak currents are used to deposit manganese directly from the bath.

Plating of Ni—Co—Mn materials is done in a sulfamate electrolyte. The ranges of metal concentration in the bath are, for example, about 50–80 g/l nickel, 1–10 g/l cobalt, and 0.5–5 g/l manganese. Manganous ions are introduced into the bath by manganous sulfamate additions. Using results of periodic bath analysis, the manganese concentration is maintained by further additions of manganous sulfamate. The nickel and cobalt concentrations in the bath are maintained through control of the current through each anode, using, for example, a Dynatronix DPD20-100-400 Dual Power Supply having a pulse duty cycle of about 33% and an average current density of about 25 Amp/ft$^2$.

Settings on the power supply 45 are adjusted to vary the length of time that current flows through the separate anodes 41, 43. Additional settings on the power supply 45 are adjusted to vary the magnitude (peak current), duty cycle, and frequency of the pulse through each anode independently. The current peak, duty cycle and/or frequency of the pulse through each anode can then be adjusted to vary the metal composition of the NiCoMn alloys.

Once the desired part thickness is deposited, the part and tool assembly is removed from the bath 37 for separation. For electro-forms deposited on aluminum, separation is performed using the thermal expansion method described above. When a nickel reverse tool 25 is used, the thermal expansion method cannot be used since both the tool 25 and the part 11 are predominately nickel. For the reusable tool electro-form, the clamps are removed and the sealant cut to allow section removal. For the sacrificial reverse tool, the tool and part are heated to approximately 350 degrees F. and the glass epoxy is removed. The thin nickel deposit is then pealed off the surface of the part. Removal of a polymeric reverse tool is accomplished by simply pealing the polymer off the part.

Following part removal, the part should be heat treated at about 1200 degrees F. in a vacuum environment for about four (4) hours to increase the material ductility and allow post electro-form machining operations, if desired.

Although the present invention has been described with particular reference to its preferred embodiments, it should be understood that many variations and modifications will now be obvious to those skilled in that art, and it is preferred, therefore, that the scope of the invention be limited, not by the specific disclosure herein, but only by the appended claims.

What is claimed is:

1. A method of fabricating an elevated-temperature resistant part with a serrated surface and elevated-temperature structural properties within about fifty percent (50%) of those of a superalloy material, the method comprising the steps of:

forming a master tool having the serrated surface;

electro-forming the elevated-temperature resistant part by depositing three alloying elements comprising nickel, cobalt and manganese onto the master tool in the amounts of about 60%–70% nickel, 40%–30% cobalt and 0.05%–0.10% manganese; and separating the elevated-temperature resistant part from master tool.

2. A method according to claim 1, wherein the step of forming the master tool comprises diamond machining a mandrel made of an easily machinable material to form quality grooves into the mandrel as the mandrel is rotated.

3. A method according to claim 2, wherein the easily machinable material is one of copper or aluminum.

4. A method according to claim 1, wherein the step of electro-forming comprises the steps of:

immersing the master tool into an electrolytic bath solution containing manganese with nickel and cobalt anodes electrically connected to a power source, wherein the master tool is electrically connected to the power source to form a cathode;

maintaining metal concentrations in the bath solution of about 50–80 g/l nickel, about 1–10 g/l cobalt, and about 0.5–5 g/l manganese during the electro-forming step; and adjusting the power supply to control the current through each anode independently to control the metal composition of the Ni—Co—Mn alloy; and removing the tool once the desired thickness of the three alloying elements are deposited.

5. A method according to claim 4, wherein the step of adjusting the power supply comprises varying at least one of a peak current, duty cycle and a frequency of an electrical pulse through each anode independently to deposit a Ni—Co—Mn alloy of about 60%–70% nickel, 40%–30% cobalt and 0.05%–0.10% manganese onto the master tool.

6. A method according to claim 4, wherein the electrolytic bath solution contains a sulfamate electrolyte.

7. A method according to claim 4, further comprising the step of circulating the electrolytic bath over surfaces of the master tool during the electro-forming step.

* * * * *